US009481852B2

(12) United States Patent
Psillas

(10) Patent No.: US 9,481,852 B2
(45) Date of Patent: Nov. 1, 2016

(54) HIGH VISCOSITY SYNTHETIC ESTER LUBRICANT BASE STOCK BLENDS

(75) Inventor: George Psillas, Berlin, CT (US)

(73) Assignee: The Lubrizol Corporation, Wickliffe, OH (US)

( * ) Notice: Subject to any disclaimer, the term of this patent is extended or adjusted under 35 U.S.C. 154(b) by 260 days.

(21) Appl. No.: 12/953,494

(22) Filed: Nov. 24, 2010

(65) Prior Publication Data

US 2011/0071063 A1 Mar. 24, 2011

Related U.S. Application Data

(62) Division of application No. 11/996,614, filed on Jan. 24, 2008, now abandoned.

(51) Int. Cl.

*C10M 129/76* (2006.01)
*C10M 171/00* (2006.01)
*C10M 105/38* (2006.01)

(52) U.S. Cl.

CPC ..... *C10M 171/008* (2013.01); *C10M 105/38* (2013.01); *C10M 2207/026* (2013.01); *C10M 2207/2835* (2013.01); *C10M 2215/223* (2013.01); *C10M 2223/041* (2013.01); *C10N 2220/022* (2013.01); *C10N 2220/302* (2013.01); *C10N 2230/02* (2013.01); *C10N 2240/30* (2013.01)

(58) Field of Classification Search

CPC ..... C10M 2207/2835; C10M 2207/026; C10M 105/38; C10M 171/008; C10M 2215/223; C10M 2223/041; C10N 2220/022; C10N 2220/302; C10N 2230/02; C10N 2240/30

USPC ..... 508/485, 501; 252/68

See application file for complete search history.

(56) References Cited

U.S. PATENT DOCUMENTS

| | | | | |
|---|---|---|---|---|
| 5,057,247 | A * | 10/1991 | Schmid et al. | 508/481 |
| 5,486,302 | A | 1/1996 | Short | |
| 5,716,916 | A | 2/1998 | Shiokawa et al. | |
| 5,820,777 | A * | 10/1998 | Schnur | C10M 105/38 252/68 |
| 6,322,719 | B2 * | 11/2001 | Kaneko et al. | 252/68 |
| 6,444,626 | B1 * | 9/2002 | McHenry et al. | 508/495 |
| 6,551,524 | B2 | 4/2003 | Schnur | |
| 6,666,985 | B2 | 12/2003 | Schnur et al. | |
| 6,774,093 | B2 * | 8/2004 | Carr | C09K 5/045 252/68 |
| 7,018,558 | B2 | 3/2006 | Schnur et al. | |
| 7,208,098 | B2 | 4/2007 | Li et al. | |
| 2003/0125218 | A1 | 7/2003 | Cardis et al. | |
| 2003/0201420 | A1 | 10/2003 | Schlosberg et al. | |
| 2004/0014611 | A1 | 1/2004 | Li | |
| 2004/0063590 | A1 * | 4/2004 | Gibb et al. | 508/485 |
| 2004/0092410 | A1 | 5/2004 | Carr et al. | |
| 2005/0029488 | A1 * | 2/2005 | Li et al. | 252/68 |
| 2007/0232506 | A1 | 10/2007 | Gao et al. | |
| 2010/0011923 | A1 * | 1/2010 | Suda et al. | 83/22 |

FOREIGN PATENT DOCUMENTS

| | | | |
|---|---|---|---|
| EP | 0430657 | A1 * | 11/1990 |
| EP | 0430657 | | 6/1991 |
| EP | 0498152 | | 8/1992 |
| EP | 0472198 | | 12/1993 |
| EP | 0730020 | | 9/1996 |
| EP | 0801129 | | 10/1997 |
| WO | 9324585 | | 12/1993 |

* cited by examiner

*Primary Examiner* — Latosha Hines

(74) *Attorney, Agent, or Firm* — Christopher P. Demas; Teresan W. Gilbert

(57) ABSTRACT

Cross blends of synthetic ester base stocks are produced from high viscosity synthetic ester base stocks having a viscosity from about iso 120 to 140 and conventional synthetic ester base stocks of varying viscosities to form base stocks having viscosities from about iso 68 to iso 220. Lubricants formed from the cross blends have sufficient miscibility with HFC refrigeration fluids with minimal use of i-$C_9$ carboxylic acids to form the ester.

2 Claims, No Drawings

HIGH VISCOSITY SYNTHETIC ESTER LUBRICANT BASE STOCK BLENDS

This application is a divisional of prior application U.S. Ser. No. 11/996,614 filed 24 Jan. 2008 and claims the benefit of said prior application.

BACKGROUND OF THE INVENTION

This invention relates to synthetic polyol ester lubricant base stocks, and more particularly to cross blends of high viscosity synthetic ester lubricant base stocks with conventional polyol ester base stocks suitable for use in compressor and refrigeration systems.

It is well known that chlorofluorocarbons previously utilized as propellants in aerosols and as refrigeration fluids are no longer used due to the adverse impact on the earth's ozone layer. Efforts to eliminate the use of chlorofluorocarbons have led to the development of alternative fluids that are highly or fully fluorinated hydrocarbons.

Working refrigeration fluids generally include a minor amount of lubricant. Typically, the refrigeration fluids include between about 5 to 15 or 20 parts by weight of lubricant with the balance being the fluorocarbon. In chlorofluorocarbon systems, lubricants were traditionally mineral oils which are fully miscible with the chlorofluorocarbons. However, such lubricants are not miscible with the highly or fully fluorinated hydrocarbons such as 1,1,1,2-tetrafluoroethane, commonly known as HFC-134a, and other chlorine-free fluorocarbons including hydrofluorocarbon (HFC) having 1 to 3 carbon atoms and preferably 1 to 2 carbon atoms, for example, difluoromethane (HFC-32), trifluoromethane (HFC-23), pentafluoroethane (HFC-125), 1,1,2,2-tetrafluoroethane (HFC-1 34), 1,1,1-trifluoroethane (HFC-1 43a), and 1,1-difluoroethane (HFC-152a).

Although HFCs are not miscible with mineral oil, certain carboxylic esters of polyhydroxy compounds, also known as polyol esters or POEs, are fully miscible with the highly or fully fluorinated fluids. The polyol ester lubricants are prepared by the condensation of certain polyols such as pentaerythritol, neopentyl glycol and trimethylpropanol, and linear or branched monocarboxylic acids containing between about 4 to 10 carbon atoms. To improve miscibility, the carboxylic acid mixture typically includes 30-85 mole % 3,5,5 tri-methylhexanoic acid (iso-C-9). However, recent events have limited the availability of iso-C-9. This shortage of iso-C-9 has made it difficult and/or expensive to manufacture polyol esters using iso-C-9.

Accordingly, it is desirable to provide synthetic ester lubricant base stocks miscible with HFCs having viscosities between about ISO 68 to 220 based on cross blends of two or more base stocks. The blend is comprised of a high viscosity synthetic base stock formed by condensation of neopentylpolyol and linear and branched monocarboxylic acids, wherein little or no iso-C-9 is used in the carboxylic acid mix, and a conventional polyol ester base stock. The cross blend is miscible with HFCs notwithstanding the limited use of isoC9, and provides an economical base stock in times where supplies of isoC9 are limited.

SUMMARY OF THE INVENTION

It is an object of the present invention to produce a wide range of polyol ester lubricants that are miscible with HFCs with minimum or no use of iso-C-9 in the carboxylic acid reaction mixture.

Another object of the present invention is to provide a lubricant base stock for air-conditioning and refrigeration systems.

Another object of the present invention is to provide an economical process of making synthetic ester base stocks that have sufficient miscibility with HFC refrigerants with limited use of iso-C-9 carboxylic acids.

Another object of the present invention is to provide a synthetic ester base stock that has sufficient miscibility with HFC refrigerants with limited use of iso-C-9 carboxylic acids that exhibits superior wear and increases compressor efficiency.

In accordance with the invention, cross blends of synthetic ester lubricants suitable for use with a wide range of HFC refrigeration fluids are provided. Applicants have discovered that cross blends of i) conventional polyol ester base stocks of varying viscosities; and ii) iso 120 to 140 high viscosity base stock, formed with little or no iso-C-9, provides a range of high and low viscosity polyol ester base stocks that are miscible with HFC refrigeration fluids and exhibit superior protection against wear.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. Detailed descriptions of well-known processes, acids, and methods for manufacturing the same are omitted so as not to obscure the description of the present invention.

Cross Blend Materials

The synthetic ester base stock blend of the present invention comprises a cross blend of a) certain high viscosity synthetic ester base stocks and b) conventional synthetic ester base stocks.

High Viscosity Polyol Ester

The high viscosity polyol ester base stock is formed by condensation of neopentylpolyol and a mix of linear and branched monocarboxylic acids in an excess of hydroxyl groups, wherein little or no iso-C-9 is used in the carboxylic acid mix. The method of making such a high viscosity synthetic ester base stock is disclosed in U.S. Pat. No. 6,774,093 which is incorporated herein by reference.

In one embodiment, the high viscosity base stock is a blend of esters which form the reaction product of a two step process. In the initial step a neopentyl polyol having from 8 to 10 carbon atoms is reacted with an acid or acid mixture of linear $C_4$-$C_{10}$ acids and/or branched $C_5$-$C_{10}$ acids in the presence of an excess of hydroxyl groups to carboxyl groups in the presence of an acid catalyst to form a partial polyneopentylpolyol ester mixture. The excess of hydroxyl groups is necessary to promote the polymerization of the partial esters and the molar ratio of acid or acid mixture to the polyol can be varied depending on the desired rate of reaction, degree of condensation and the ultimate desired viscosity of the base stock. When the anticipated water of reaction has been removed from the reaction vessel to yield a product of desired viscosity, the resulting partial polyneopentylpolyol ester is then reacted with an excess of an acid or acid mixture that can vary or be the same acid mixture used in the initial step to yield the high viscosity ester product.

More particularly, the high viscosity polyol ester used in the cross blend of the present invention has a viscosity of iso 120 to 140 and is made in accordance with the method described above and in the '093 patent using a blend of pentaerythritol and dipentaerythritol reacted with a blend of carboxylic acids selected from one or more of $C_5$, iso-$C_5$, $C_7$, hexanoic, iso$C_9$ and $C_9$ monocarboxylic acids.

In one embodiment the iso 120 to 140 high viscosity polyol ester is made using a 60/40 blend of pentaerythritol and dipentaerythritol reacted with carboxylic acids selected from one or more of n$C_5$, iso-$C_5$, n$C_7$, hexanoic and $C_9$ in the presence of an excess of hydroxyl groups to carboxyl groups. The reaction continues until it yields a product of the desired viscosity. A high density polyol ester having a viscosity between iso 120 and iso 140 provides sufficient miscibility with refrigerant R134a from −38° C. to 80° C. even without the use of iso-$C_9$ as one of the carboxylic acids.

Conventional Polyol Ester

Conventional polyol ester base stocks, as used herein, is intended to mean synthetic ester base stocks prepared by standard condensation reaction of neopentylpolyol and a selection of linear and branched monocarboxylic acids.

The conventional ester base stocks of the present invention are polyol ester based lubricants made by a conventional condensation reaction of polyols and carboxylic acids. The conventional polyol ester base stocks have a viscosity range from iso 20 to iso 350 and are available from a number of sources including Castrol Industrial North America Inc. Warrenville, Ill. under the Icematic brand, Cognis (under the Evergreen brand name), Uniqema Corporation RL series, CPI's Solest brand of POEs, Mobil EAL Arctic, JEC, and Nippon Oil.

Lubricating Oil Composition

A variety of additives may be added to the cross-blends to make the fully-blended refrigeration lubricant. These additives include: anti-oxidants, anti-wear additives and metal deactifiers.

Anti-Oxidants

A fully-blended refrigeration lubricant may contain from about 0.01% to 1% by weight, alternatively from about 0.05% to 0.5% by weight, alternatively from about alternatively from about 0.10% to about 0.20% by weight, of one or more antioxidants.

Anti-oxidants reduce the tendency of lubricating oils to deteriorate in service. This deterioration can be evidenced by increased oil viscosity and by the products of oxidation such as acids, sludge and varnish-like deposits on the metal surfaces. In one embodiment 0.10 wt % BHT is used.

Anti-Wear Agent

A fully blended refrigeration lubricant may also contain from about 0.0075% to 3% by weight, alternatively from about 0.01% to about 2% by weight, alternatively from about 0.06% to about 1% by weight, of one or more anti-wear agents.

Anti-wear agents, as their name implies, reduce wear of metal parts. Anti-wear agents commonly used in refrigeration lubricants include Vanlube 672 which is available from RT Vanderbilt and tricresyl phosphate (TOP) antiwear additives.

Metal Deactifier

A fully blended refrigeration lubricant may also contain from about 0.001% to 0.1% by weight, alternatively from about 0.0075% to about 0.05% by weight, of one or more metal deactifier such as tolutriazole (available from Ciba Specialty Ohemiclas under the trade name Irgamet TTZ) and sebacic acid corrosion inhibitors. In one embodiment 0.01% by weight of tolutriazole (TTZ) is used.

Other Additives

Other additives include acid blockers such as Texaco's Oadura E-10.

Blending Conditions

The cross blends of the present invention are made by blending high viscosity polyol ester having a viscosity in the range of iso 120 to iso 140 with conventional polyol esters of viscosity grade iso 20 to iso 350 to achieve the desired final viscosity. The high viscosity and conventional polyol esters along with a selection of additives, if any, are blended in a steam-jacketed stainless kettle at a temperature range of 120° C. to 180° O for around 24 hours.

The desired viscosity grade of the cross blends is achieved by blending in accordance with the following cross blend chart.

Cross Blends

| | iso 32 cross-blend | iso 68 cross-blend | iso 120 cross-blend | iso 220 cross-blend |
|---|---|---|---|---|
| High viscosity POE | 15 wt % iso 120 | 73 wt % iso 120 | 100 wt % iso 120 | 60 wt % iso 120 |
| Conventional POE | 85 wt % iso 20 | 27 wt % iso 20 | — | 40 wt % iso 350 |

EXAMPLES

The Examples are for illustration only and not intended to limit the scope of the invention.

Example 1

High Density Polyol Esters Miscible with 134a

The following example illustrates that only certain high viscosity polyol esters made in accordance with the '093 patent are miscible with R 134a.

| COMPOSITION Made using '093 process | | | | | | |
|---|---|---|---|---|---|---|
| polyol, MOL % | 100% | 100% | 100% | 100% | 100% | 100% |
| Acids MOL % | | | | | | |
| nC5 | 100% | 50% | | 56% | 5% | 66% |
| nC6 | | | | | | |
| nC7 | | | 20% | | | |
| nC9 | | | | | | |
| nC8 | | | | | | |
| 3 METHYL VALERIC 10% | | | 10% | | | |
| iso-C5 | | | | 34% | | 34% |

-continued

| COMPOSITION Made using '093 process | | | | | | |
|---|---|---|---|---|---|---|
| Hexanoic | | | | 10% | | |
| 2-EH | | | 70% | | 95% | |
| iso-C9 | | 50% | | | | |
| Other Additives | | | | | | |
| BHT % | 0.10% | 0.10% | 0.10% | 0.10% | 0.10% | 0.10% |
| Physical/Chemical Properties | | | | | | |
| Reacted Viscosity | 220 | 220 | 232 | 139 | 196 | 120-139 |
| 40 C. | 220 | 220 | 232 | 139 | 196 | 120 |
| R134a Miscibility at Room temp C. | Not | Not | Not | −38 | Not | −39 |

The data demonstrates that only high viscosity polyol esters having a viscosity in the range of iso 120 to iso 140 are miscible with R 134a. Thus, the cross blends should be made with high viscosity polyol esters in this range.

Example II

Cross Blends

| Cross Blend Sample No. | % iso C-9 Blend | | % ant-wear additive | BHT | TTZ % |
|---|---|---|---|---|---|
| 1 | 0 | 27% SW20<br>73% VG120 | 0.03% | 0.10% | 0.01% |
| 2 | 0 | 27% SW20<br>73% VG120 | 0.00% | 0.10% | 0.01% |
| 3 | 0 | 27% SW20<br>73% VG120 | 0.015% | 0.10% | 0.01% |
| 4 | 0 | 27% SW20<br>73% VG120 | 0.0075% | 0.10% | 0.01% |
| 5 | 0 | 100% VG120 | 0.00% | 0.10% | 0.01% |
| 6 | 45 | 40% SW350<br>60% VG120 | 0.00% | 0.10% | 0.01% |

VG12O = high viscosity grade of iso 120 available from Hatco Corporation
SW20 = iso 20 POE available from Castrol Industrial North America
SW68 = iso 68 POE available from Castrol Industrial North America
SW220 = iso 220 POE available from Castrol Industrial North America
SW350 = iso 350 POE available from Castrol Industrial North America.

Example III

Wear Data

The wear properties of the cross blends were tested in accordance with ASTM D2670 Falex Pin and Vee Block Test. The Falex Pin & Vee Block Test evaluates the extreme pressure properties or wear characteristics of a lubricant. The machine rotates a test pin against two stationery Vee Blocks at 290 rpm. Load is applied to the Vee blocks through a ratchet mechanism and the test specimen is immersed in the cross blend lubricant while R-134a refrigerant is bubbled up through the lubricant. A 250 lb. load was applied for the first 5 minute break-in period and a 400 lb. load was applied for the 30 minute duration of the test. wear is measured and reported as the number of teeth the ratchet mechanism advances in order to maintain constant load during the prescribed test time. The results for the cross blends are in Table III.

TABLE III

Falex Pin and Vee Block Wear Data average of three runs

| | Tooth | Wear Data measured in Mass in grams Lost | | |
|---|---|---|---|---|
| | Count | Pin | Vee Block 1 | Vee Block 2 |
| Cross Blends Sample No. | | | | |
| 1 | 7 | 0.0016 | −0.0007 | 0.0002 |
| 2 | | | | |
| 3 | 15[2] | 0.014[2] | 0.0005[2] | 0.0002[2] |
| 4 | 13.75[1] | 0.0132[1] | 0.0007[1] | 0.0002[1] |
| 5 | | | | |
| 6 | | | | |
| Conventional POEs | | | | |
| Icematic SW 68 | 23.5[1] | 0.0196[1] | 0.0007[1] | 0.00085[1] |

fn[1] Average of 4 runs
fn[2] Average of 3 runs

What is claimed is:

1. An air-conditioning or refrigeration system polyol ester lubricant base stock comprising a cross blend of 73 wt % of a high viscosity polyol ester base stock having a viscosity from about 120 to 140 centistokes at 40 degrees C. and 27 wt % of a conventional polyol ester base stock having a viscosity of about 20 centistokes at 40 degrees C. resulting in the cross blend having a viscosity of about 68 centistokes at 40 degrees C.; and wherein the high viscosity polyol ester base stock is derived from a condensation reaction of neopentylpolyol and a mixture of $C_5$-$C_7$ linear and $C_5$ branched monocarboxylic acids.

2. An air-conditioning or refrigeration system polyol ester lubricant base stock comprising a cross blend of 60 wt % of a high viscosity polyol ester base stock having a viscosity from about 120 to 140 centistokes at 40 degrees C. and 40 wt % of a conventional polyol ester base stock having a viscosity of about 350 centistokes at 40 degrees C. resulting in the cross blend having a viscosity of about 220 centistokes at 40 degrees C.; and wherein the high viscosity polyol ester base stock is derived from a condensation reaction of neopentylpolyol and a mixture of $C_5$-$C_7$ linear and $C_5$ branched monocarboxylic acids.

* * * * *